United States Patent [19]

Wood

[11] 4,142,769

[45] Mar. 6, 1979

[54] ELECTRICAL CONNECTOR

[75] Inventor: Theodore H. Wood, Brewster, Mass.

[73] Assignee: Alden Research Foundation, Westboro, Mass.

[21] Appl. No.: 859,252

[22] Filed: Dec. 9, 1977

[51] Int. Cl.[2] ..... H01R 7/32; H01R 13/54

[52] U.S. Cl. ..... 339/88 R; 339/61 R; 339/90 R

[58] Field of Search ..... 339/88 R, 88 C, 90 R, 339/90 C, 91 R, 181 RC, 188 RC, 61 R, 61 M, 119 L, 75 P, 125 L; 285/88, 87, 256, 382, 338, 396

[56] References Cited

U.S. PATENT DOCUMENTS

| | | | |
|---|---|---|---|
| 2,378,105 | 6/1945 | Roesch | 339/90 R |
| 2,787,770 | 4/1957 | Arson | 339/90 R X |
| 3,656,003 | 4/1972 | Brook | 339/39 |

FOREIGN PATENT DOCUMENTS

| | | | |
|---|---|---|---|
| 767549 | 2/1957 | United Kingdom | 339/88 |

*Primary Examiner*—Joseph H. McGlynn
*Assistant Examiner*—E. F. Desmond
*Attorney, Agent, or Firm*—Grover & Meegan

[57] ABSTRACT

An electrical connector including male and female sections which are adapted to be joined together and clamped with extensions from the sections to insure a tight fit without permanently stressing the yieldable material which is used to form the device.

11 Claims, 6 Drawing Figures

ELECTRICAL CONNECTOR

BACKGROUND

The present invention relates to electrical connectors and particularly to an improved mechanism for retaining such connectors together.

PRIOR ART

In the past such connectors have been joined together simply by disposing a male lead into a telescoping female lead. A protuberance within the female lead engaged a detent disposed upon the male lead to secure a physical connection and provided electrical contact. Such connections, however, become loose quite easily and even disengage and can disrupt the system in which they are used.

SUMMARY OF THE INVENTION

The present invention involves an electrical connector which includes two tubular members generaly formed of a thermoplastic material which has insulating properties. These tubular members telescope on a common axis and have interengaging connectors which are arranged as peripheral extensions from the body one of which extends from the male portion of the connector and the other of which extends from the female portion. In the preferred embodiment, the extension from the female portion overlaps the tube which forms part of the male member. A recess is disposed within the overlapping extension and the extension from the male member is arranged to fit into the recess when the two members are counter-rotated. A lead corner on the extension from the male member will contact the extension from the female member and twisting will slightly deform the tubes allowing the corner to pass. After passage, which produces a click and snap-action, the tubes will regain their original shape and the extension from the male member will be seated in the recess in the extension from the female member to lock the male and female sections of the connector together.

In the above described embodiment of the invention, the tubular member forming part of the male portion is molded as part of a grip and a single male electrical lead is inserted into a single female electrical receptor. In a second embodiment, however, the tubular member is rotatably associated with the grip and in this way, a plurality of female receptors can be joined with a plurality of male leads. The male leads are plugged into the female receptors and the tube disposed about the male members can swivel to secure the connector together without moving the male leads.

DRAWINGS

DESCRIPTION OF THE INVENTION

Figure 1:
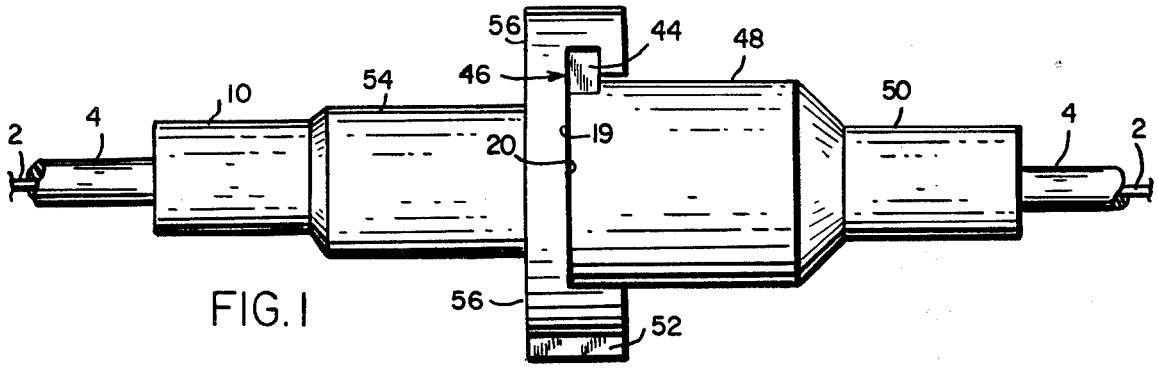
FIG. 1 is an elevational view of an electrical connector according to this invention.

Referring now to FIG. 1, the female portion of the electrical connector is formed of a female tubular member 54 which externally terminates in a female grip 10 that is disposed and sealed about a wire 2 which, in turn, is encased within an insulator 4. The male portion of the electrical connector is formed of a male tubular member 48 which externally terminates in a male grip 50 that is disposed and sealed about a wire 2 which, in turn, is also encased in an insulator 4. A lateral extension 56 is integrally disposed upon the outside of the female tubular member 54 and arranged to overlap the male tubular member 48. A recess 46 is disposed within the lateral extension 56 and forms four surfaces therein to retain radial extensions 44 (only one shown) which extend from the outside of the female tubular member 48. A shoulder 19 forms the end of the male tubular member 48 and butts against the inner surface 20 of the lateral extension 56 of the female tubular member 54. A step 52 is provided on the outside of radial extension so that the female connectors can be gripped with a pair of pliers when the device is being used in a panel.

Figure 2:
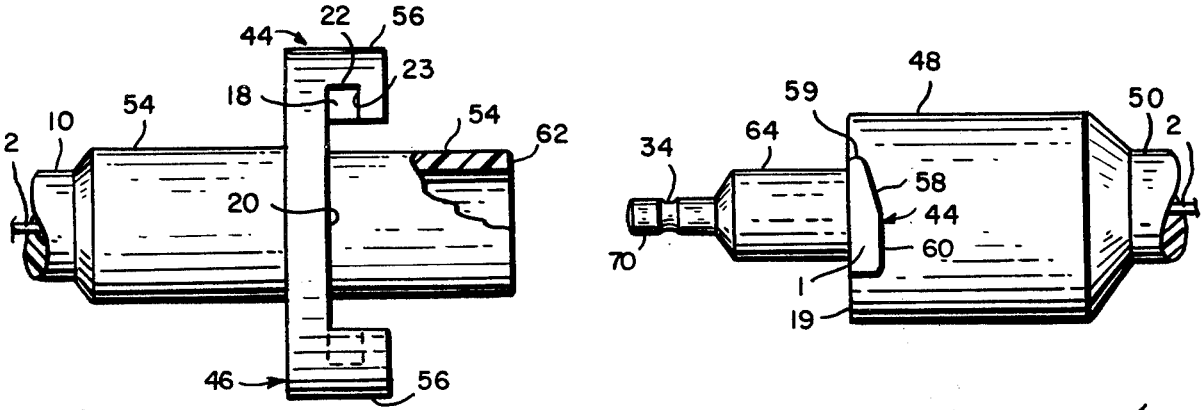
FIG. 2 is an elevational view, partially in section, of the connector of FIG. 1 in which the male and female sections of the connector have been separated.

As shown in more detail in FIG. 2, the female tubular member 54 of the electrical connector extends inwardly from the lateral extension 56 to end in a shoulder 62 and is adapted to receive the male portion of the connector. The male member includes a casing 64 disposed about the wire 2 and housed within the female tubular member 48. Radial extensions 44 (only one shown) are disposed on the outside of male tubular member 48. Male tubular member 48 is spaced from casing 64 and is adapted to receive female tubular member 54 in the space that is formed therebetween. Casing 64 provides insulation and support for the electrical wire 2 which extends through the body to terminate in nipple 70. A detent 34 is formed on nipple 70 and is arranged to fit into a cooperating detent in the female portion of the electrical connector, as will be seen in FIG. 3.

The radial extensions 44 preferably include a lead corner 59, an inclined plane 58 and a cooperating platform 60. When the male and female portions of the connector are joined together, the radial extensions 44 are first slipped between the lateral extensions 56 until shoulder 19 butts against inner surface 20. The two members are then counter-rotated and the lead corners 59 (only one shown) will slide into the recesses 46 (only one shown) until they contact linear surface 22. The distance between lead corners 59 and the axis of the male portion of the connector is slightly more than the distance between linear surface 22 and the axis of the female portion of the connector, and when force is applied the material which forms the connector will deform slightly allowing the lead corners 59 to pass. Following the passage of the lead corners 59, the thermoplastic material will regain its original shape and ramp 58 will contact the sidewall 23 and urge the shoulder 19 against the inner surface 20. Continual rotation will force the platform 60 against the sidewall 23 until lead edge 59 contacts stop 18 to secure the lock. At that point the outer edge 1 of the radial extension 44 will be substantially parallel to the linear surface 22 which, in turn is normal to the axis of the connector. Through the use of the above-described lead corners and linear surfaces, the male and female portions of the connector snap together to provide audiogenic and tactile assurance that the lock is secured. Also, unlocking of the connector provides similar positive assurances that the clamping is disengaged and the connector can be separated.

Figure 3:
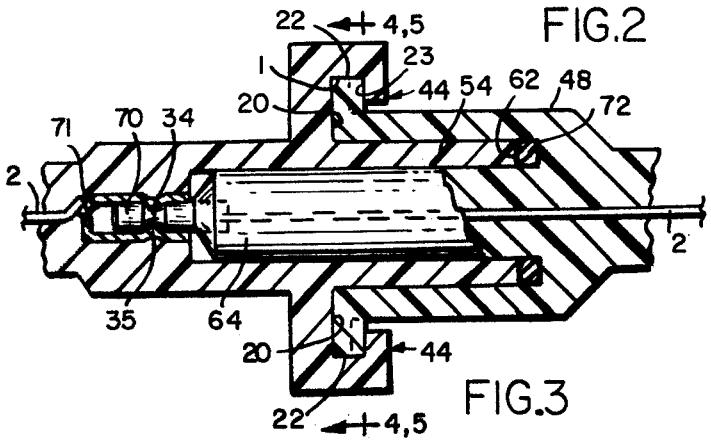
FIG. 3 is a cross sectional view of the connector shown in FIG. 1.

In FIG. 3, a cross section of the connector is illustrated. The male and female sections are joined together with the nipple 70 seated within a receptor 71 and a protuburance 35 is held in a detent 34. As shown, the female tubular member 54 snugly fits in the space between the casing 64 and the male tubular member 48 when the male and female portions of the connector are joined together. The shoulder 62 is disposed against a resilient O-ring 72 that is seated in the bottom in the above-mentioned space. Because of the cooperative action of ramp 58 (shown in FIG. 2) which urges shoulder 62 towards the bottom of the space, the O-ring 72 which is disposed therebetween will be compressed to enhance the connection and inhibit any flow of water vapor into the area of the electrical connection.

Figure 4:
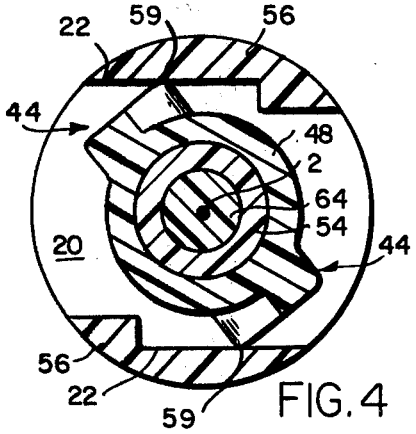
FIGS. 4 and 5 are cross sectional views taken along the lines 4—4 of FIG. 3 and illustrate two stages of rotating the male portion of the connector within the female portion.
Figure 5:
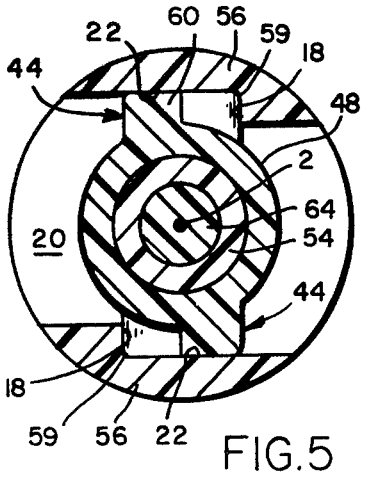

FIGS. 4 and 5 show two stages of closing the connector. The casing 64 is disposed about the wire 2 which is located on the axis of the connector. The female tubular member 54 encircles the casing 64 and, in turn, the male tubular member 48 is disposed about the female tubular member 54. In the preferred embodiment, the two radial extensions 44 are disposed 180° apart on the outside of the male tubular member 48. Lead corners 59 will initially touch linear surfaces 22 when the male portion of the connector is rotated in the female portion because the radii of the male member measured from the axis to the lead corners 59 are slightly greater than the radii measured from the axis to the linear surfaces 22. Preferably the difference is about 0.1 to 0.3 mm. which will provide the "snap action" locking that was described previously. Continual rotation of the male member will force the linear surfaces 22 to be displaced somewhat and/or cause the male tubular member 48 to collapse. After the lead corners 59 pass the point of contact with the linear surfaces 22, the tubular members will regain their original shape. Quite importantly the stress imposed upon the tubular members is of a short duration and only takes place during the time of contact of the lead corner 59 with the linear surface 22. Hence the members will not permanently deform due to the pressure and cold flow characteristics of the material of which the connector is formed. After the lead corners 59 contact the stops 18, the male tubular member 48 and/or the linear surface 22 will regain their original shapes to relieve the stress and prevent the materials from permanently deforming.

Figure 6:
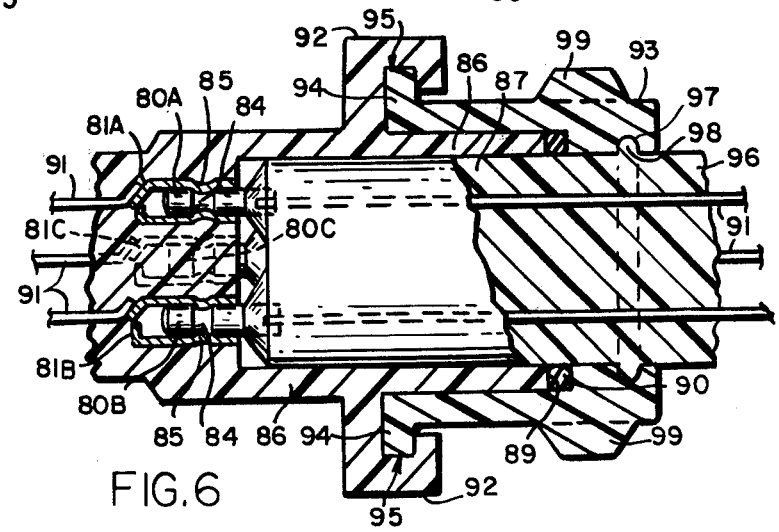
FIG. 6 is a sectional view similar to FIG. 3 in which a plurality of male leads are inserted into a plurality of female receptors.

Another embodiment of the present invention is shown in FIG. 6 of the drawings. The male and female sections are joined together with a plurality of nipples 80A, 80B, and 80C being seated within a plurality of receptors 81A, 81B, and 81C. Protuberances 85 are disposed in detents 84 and a plurality of wires 91 extend through the connector and are attached to the nipples 80 and receptors 81. As shown, female tubular member 86 snugly fits in the space between the casing 87 and the male tubular member 88 when the male and female portions of the connector are joined together. A shoulder 89 is disposed against a resilient O-ring 90 that can be seated in the bottom of the space when the sections are joined together to aid in the clamping and inhibit the introduction of atmospheric water vapor into the connector.

The female tubular member 86 can be of substantially the same construction as the female tubular member described with reference to FIG. 3 except that it houses a plurality of female receptors. The radial extensions 92 are disposed thereon and are arranged so that when the connector is locked, shoulder 89 will butt against O-ring 90. The male tubular member 93 similarly has radial extensions 94 which extend therefrom and seat in the recess 95 that is formed in the lateral extension 92. The male tubular member 93 is not rigidly molded to the grip 96, however, as is the case in the embodiment illustrated in FIG. 3. Rather, the male tubular member 93 can have an internal channel 97 which can encircle a ring 98 that is formed on the periphery of the grip 96. In this way, the male member 93 is free to rotate about the grip 96 when the male and female connections are joined together. The channel and ring can also be eliminated, if desired, and the tubular member 93 can be free to slip over the grip when the lock is disengaged. Preferably, small tabs 99 are disposed on the male member 93 to aid in turning and clamping the connector together.

It is apparent that modifications and changes can be made within the spirit and scope of the present invention. For example, the radial and lateral extensions of the male and female tubular member can be reversed and the lateral extension can be placed upon the male tubular member and the radial extension can be placed upon the female tubular member to form a mirror-image disposition of the parts. It is our intention, thus, only to be limited by the spirit and scope of the appended claims.

I claim:

1. An electrical connector comprising:

a first and a second tubular member of yieldable material, telescoping on a common axis;

interengaging connector means associated with each of the respective tubular members;

a lateral extension from one member overlapping the other member, said lateral extension having a recess with a radially inwardly facing, substantially linear surface and an adjacent radially inwardly extending sidewall;

a radial extension from the other member rotatively engaging in said recess to hold the members telescoped and the conductors engaged; the radial extension having an edge with a lead corner of a greater radius than the linear surface which engages the linear recess to deform at least one of said members as the radial extension enters the recess, said members regaining their original shape as the lead edge is rotated into the recess with a snap-action locking of the members together.

2. The connector according to claim 1 wherein the linear recess surface is substantially normal to the common axis of the connector.

3. The connector according to claim 2 wherein the outer edge of the radial extension is generally linear and snaps into parallelism with the linear surface.

4. The connector according to claim 3 wherein a casing is disposed about one of said connector means and spaced from the respective tubular member by a distance sufficient to house the tubular member of the other connector means.

5. The electrical connector according to claim 4 wherein the yieldable material is a thermoplastic insulating material.

6. The connector according to claim 4 wherein an O-ring is disposed at the base of the said respective tubular member and the tubular member of the other connector means is arranged to abut it.

7. The connector according to claim 1 wherein there are two spaced apart radial extensions adapted to be fitted into the recesses of two equally spaced apart lateral extensions.

8. The connector according to claim 1 wherein the tubular member is rotatably disposed on a grip and free to turn without turning the connector means associated with the respective member.

9. The connector according to claim 8 wherein there is more than one connector means associated with each of the respective tubular members.

10. The electrical connector according to claim 1 wherein the lead corner of the radial extension forms part of the lowest portion of a ramp which is arranged to contact the sidewall of the recess formed in the lateral extension, said ramp being arranged to aid in seating the interengaging connector means.

11. The electrical connector according to claim 10 wherein the radial extension further includes a platform disposed at the highest portion of the ramp, said platform being generally linear and arrranged to snap into parallelism with said sidewall where said lead corner is fully rotated into said recess.

* * * * *